United States Patent [19]

Krause et al.

[11] 4,087,092

[45] May 2, 1978

[54] RANDOM GENERATOR INSTANT GAME AND METHOD

[75] Inventors: Stephen R. Krause, Baltimore, Md.; Max Goldman, Cherry Hill, N.J.; Emanuel Gnat, New York, N.Y.

[73] Assignees: Tele Vend Inc., Baltimore, Md.; SOI, Princeton, N.J. ; part interest to each

[21] Appl. No.: 730,682

[22] Filed: Oct. 7, 1976

[51] Int. Cl.[2] ..... A63B 71/00

[52] U.S. Cl. ..... 273/138 A

[58] Field of Search ..... 273/138 R, 138 A, 85 R, 273/139, DIG. 28, 1 E, 138, 85; 235/92 GA, 61.7 R; 340/323 R, 172.5; 445/1

[56] References Cited

U.S. PATENT DOCUMENTS

| | | | |
|---|---|---|---|
| 3,124,674 | 3/1964 | Edwards et al. | 235/92 TA |
| 3,688,276 | 8/1972 | Quinn | 340/172.5 |
| 3,770,269 | 11/1973 | Elder | 273/138 A X |
| 3,786,234 | 1/1974 | Trent et al. | 273/138 A |
| 3,810,627 | 5/1974 | Levy | 273/138 A |
| 3,929,338 | 12/1975 | Busch | 273/138 A |

OTHER PUBLICATIONS

*Applications of Linear Integrated Circuits*; Hnatek, E. R.; 1975; p. 301.

*Primary Examiner*—Richard C. Pinkham
*Assistant Examiner*—Vance Y. Hum

[57] ABSTRACT

The invention is a commercial or lottery instant game played with a ticket which bears a pre-printed number for the lottery game and no number for the commercial game. A random generated number is printed on the ticket for digit comparison with the pre-printed lottery number or digit sameness comparison of the printed random number on the commercial ticket. Sensing of the ticket stops a random number generator with a memory holding the random number developed on stopping. This number is printed on the ticket and displayed. In the absence of a ticket the device displays changing numbers as an attraction. The ticket may be validated by sensing and encoded with special information.

17 Claims, 8 Drawing Figures

TO 7 SEGMENT DISPLAY
FROM FIG.5A
FROM FIG. 5A
VCC
1KΩ
E16
E17
E18
E24
E25
E26
E20
E21
E22
E4
E3
E29a
E30
E31
E32
F10
105
107
109
117
119
99
103
59
61
10.0μfd
6.8KΩ
10μfd
4.1KΩ
.01 μfd
0.1 μfd
RESET
OUT
TR
CV
CRY
LD
CLR
EN

RANDOM GENERATOR INSTANT GAME AND METHOD

The present invention relates to a random number type game played with a ticket having a pre-printed number thereon which ticket is inserted into the game machine for receiving a random number for comparison with the pre-printed number. In a commercial preferred version of the invention, the ticket does not carry a pre-printed number but rather merely receives a number from the game machine, the digits of which are matched one against the other for sameness to discover the extent of win, if any.

Progressive wins, in the first-mentioned lottery version of the game, may be instantly determined by, for example, matching the first digit or the last digit, or matching any two digits through all five digits, the prize growing disproportionately larger as more digits are matched. The latter is true with respect to the commercial version in matching digits of the single number printed out by the game.

In general, the game can be employed as a part of a pre-selected number lottery, a commercial game with cash register receipt tapes or the like, or solely as an instant game, per se or with advertising objectives.

The game is self-policing in that a control number may be printed on the ticket, as derived from selected bits of the BCD random number and selected bits from the agent or location number; the printer applying all three of these numbers to the ticket.

The ticket is produced by a computer or the like and carries the pre-printed number in a column above which the random number will be printed, so that all five digits (more or less) of each number are aligned vertically for instant comparison.

The apparatus for handling the ticket is primarily electronic and may be housed within a 10-inch cube. The ticket is inserted in a slot and photo-diodes sense its presence and a pre-punched hole or coded dots to determine if the ticket is valid. If so, the continuously running random number generator receives a sample and hold command, which at this moment, places five random digits in the memory. At the same time, the control number is generated from the location designation and the random number and placed in an encoding matrix which generates from this information a two-digit code number representing part of the five-digit random number and part of the multi-digit location number. The encoding step may be omitted and the game, of course, may be played with or without the validation step.

A display on the front of the panel then illuminates the five-digit random number selected and the printer is activated to print the location number, random number and code number. When the ticket is removed, the system resets itself.

As an attractive, changing or "dancing" numbers may be applied to the display, which numbers are automatically discontinued upon insertion of the ticket in order that the printed number may be displayed. The changing numbers may be generated by individual counters operating at different frequencies, with selected counters being run up and selected counters down, in continuous fashion, for display of the individual changing digits.

The game may be played for free tickets and cash in those places where lawful or for free merchandise, such as in grocery stores where acceptable. Another very important use of either game is in the advertising field. For example, at shows, one booth may sponsor such a machine and free tickets are given out at the entrance to the convention. The player simply appears at the sponsoring booth and plays the game to win cash or other prizes. It has been found that such game equipped booths command the greatest attention in the convention hall.

The invention will be better understood from a reading of the following detailed description thereof, when taken in light of the accompanying drawings wherein.

FIGS. 5A, 5B, 5C and 5D comprise this diagram as single sheets which fit together according to the labeled interconnecting leads.

Figure 1:
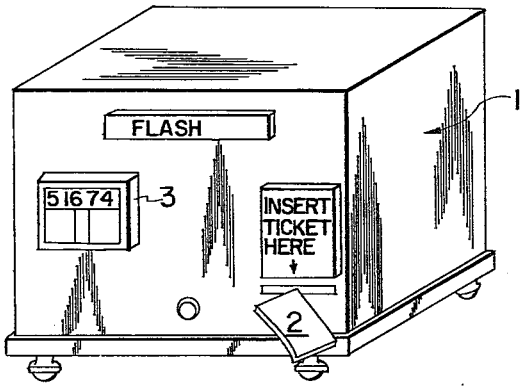
FIG. 1 is a view in perspective of the game housing.

In FIG. 1, the 10-inch cube housing 1 is shown for the instant game herein named "FLASH." The ticket 2 is being shown inserted into the ticket slot for instant printing of the number 51674 displayed at the display window 3.

Figure 2:
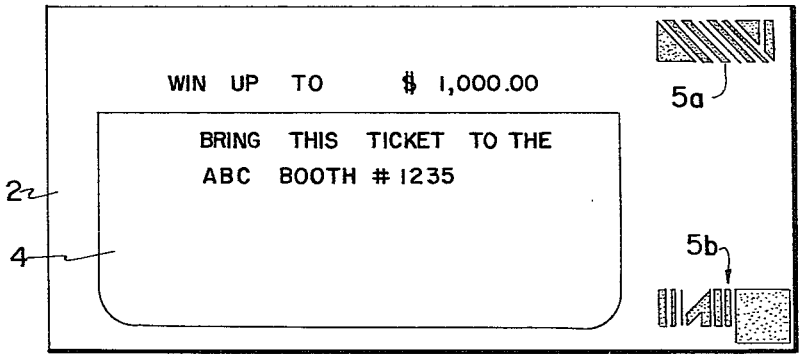
FIG. 2 is a view of a typical ticket without preprinted numbers.

In FIG. 2, a typical commercial ticket is shown including the advertising space 4 wherein the ABC booth is touted through the use of the subject game device. At the upper right and lower right of the ticket there is shown two validating areas **5*a* and 5*b*. It is the configuration of these predetermined markings which is sensed to determine if the ticket is valid. In the event ticket 2 were of the lottery type rather than the commercial form, it would simply carry a pre-printed lottery number in the region between indicia 5*a* and 5*b* and the printer within housing 1** would print the random number in alignment with the pre-printed number for instant comparison.

Figure 3:
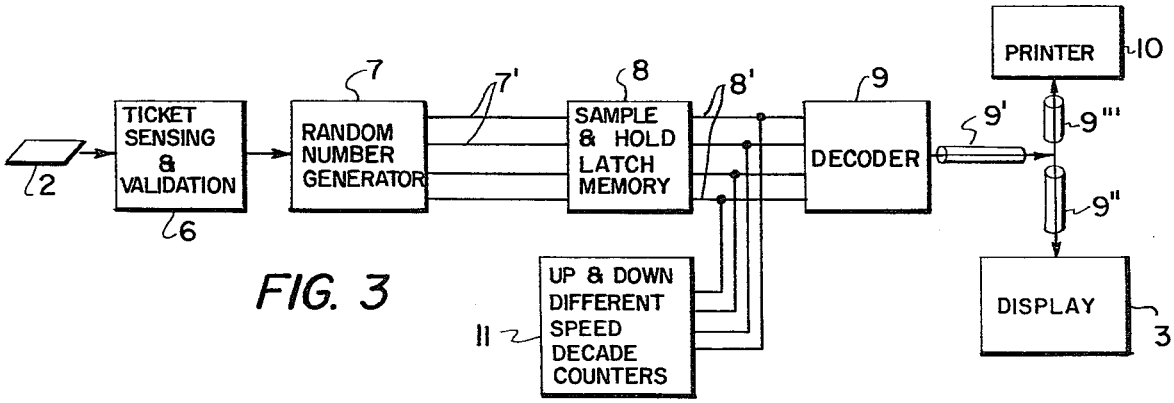
FIG. 3 is a block diagram of the preferred commercial embodiment of the invention which utilizes the ticket of FIG. 2.

In FIG. 3, the block diagram for the preferred embodiment, i.e., the commercial version, is shown with the ticket 2 being introduced into the TICKET SENSING AND VALIDATION section 6, it being borne in mind that all of the components of FIG. 3 are contained within housing 1 of FIG. 1. Ticket sensing and/or validation stops RANDOM NUMBER GENERATOR 7 on a multi-digit number which is held in the SAMPLE AND HOLD LATCH MEMORY 8. The RANDOM NUMBER GENERATOR 7 conveniently produces a four-digit BCD number, for example, which is transferred over the four leads 7'. From the SAMPLE AND HOLD LATCH MEMORY 8, the selected random number is transferred over BCD leads 8' to DECODER 9 and thence via multiple leads 9' and 9'' to DISPLAY 3. Also from the DECODER 9, leads 9''' carry the multiple digit number to be printed to PRINTER 10.

Whenever a ticket 2 is absent from housing 1, DISPLAY 3 exhibits "dancing" numbers. These numbers are generated by the UP AND DOWN DIFFERENT SPEED DECADE COUNTERS of the display number generator 11. The four digits from UP AND DOWN COUNTERS 11 are transferred over BCD leads 11' and via DECODER 9 to DISPLAY 3. It will be seen that DECODER 9 performs the same function for the "dancing numbers" as it does for the random number, and this is possible because the "dancing numbers" are inhibited when a ticket is presented to housing 1 so that DECODER 9 is available for handling the random number.

Figure 4:
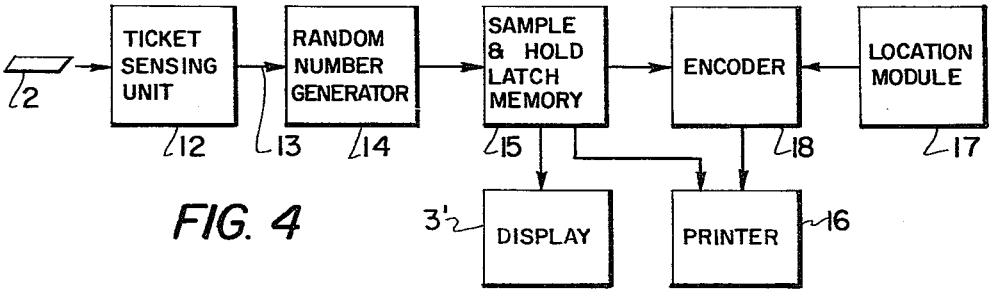
FIG. 4 is a block diagram of the lottery type game invention.
Figure 5A:
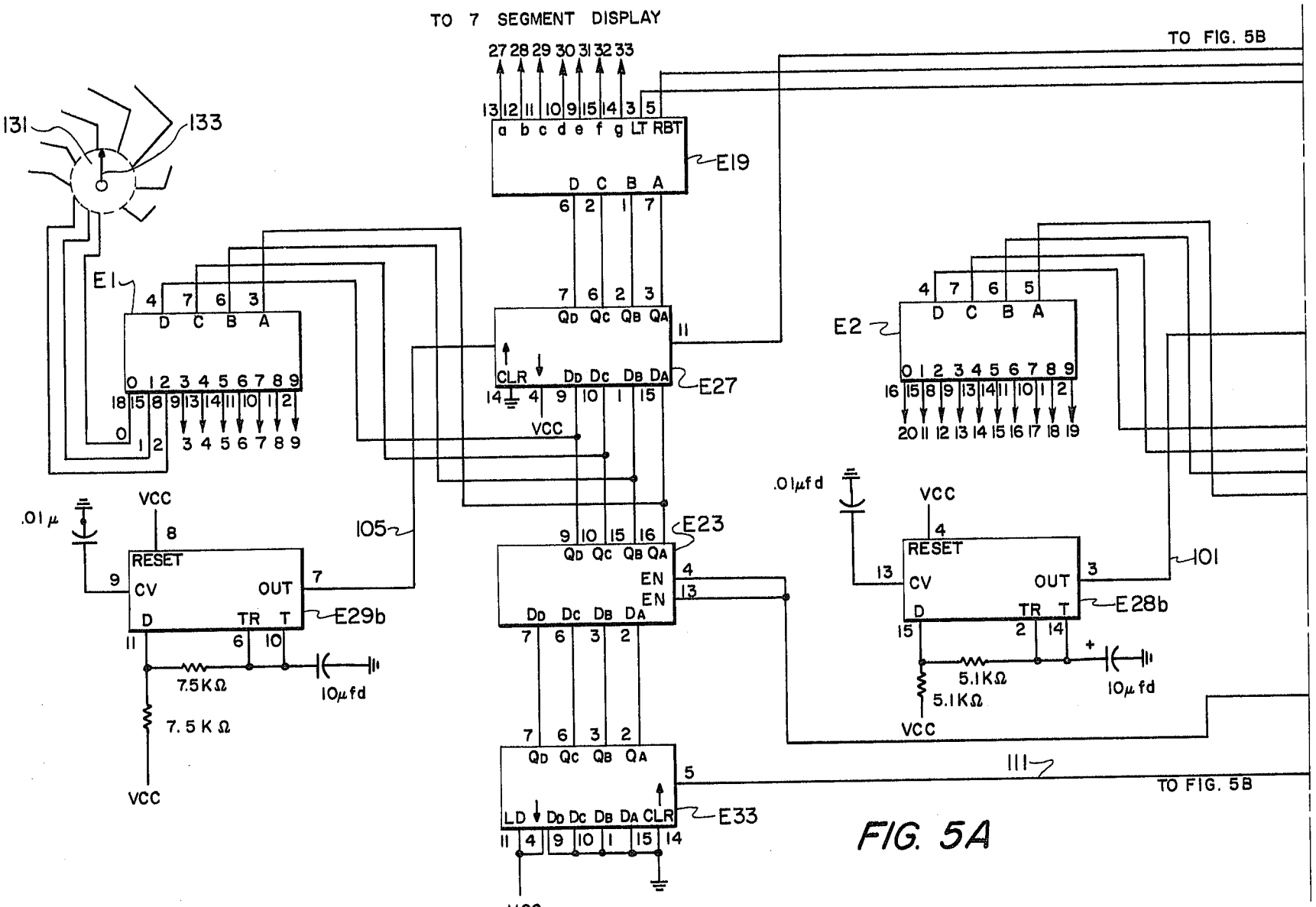
FIG. 5 is a detailed circuit diagram of the preferred embodiment.
Figure 5B:
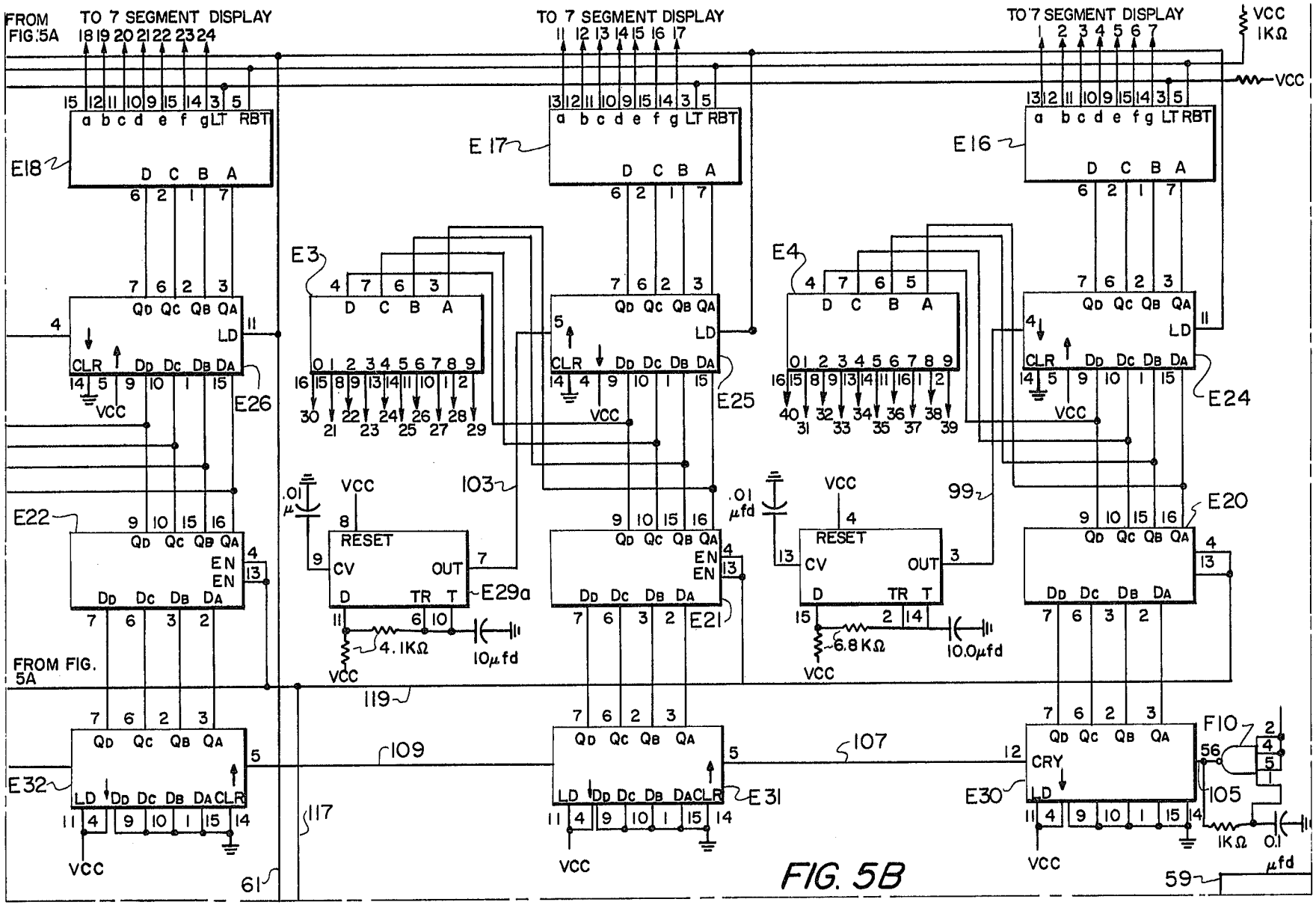
Figure 5C:
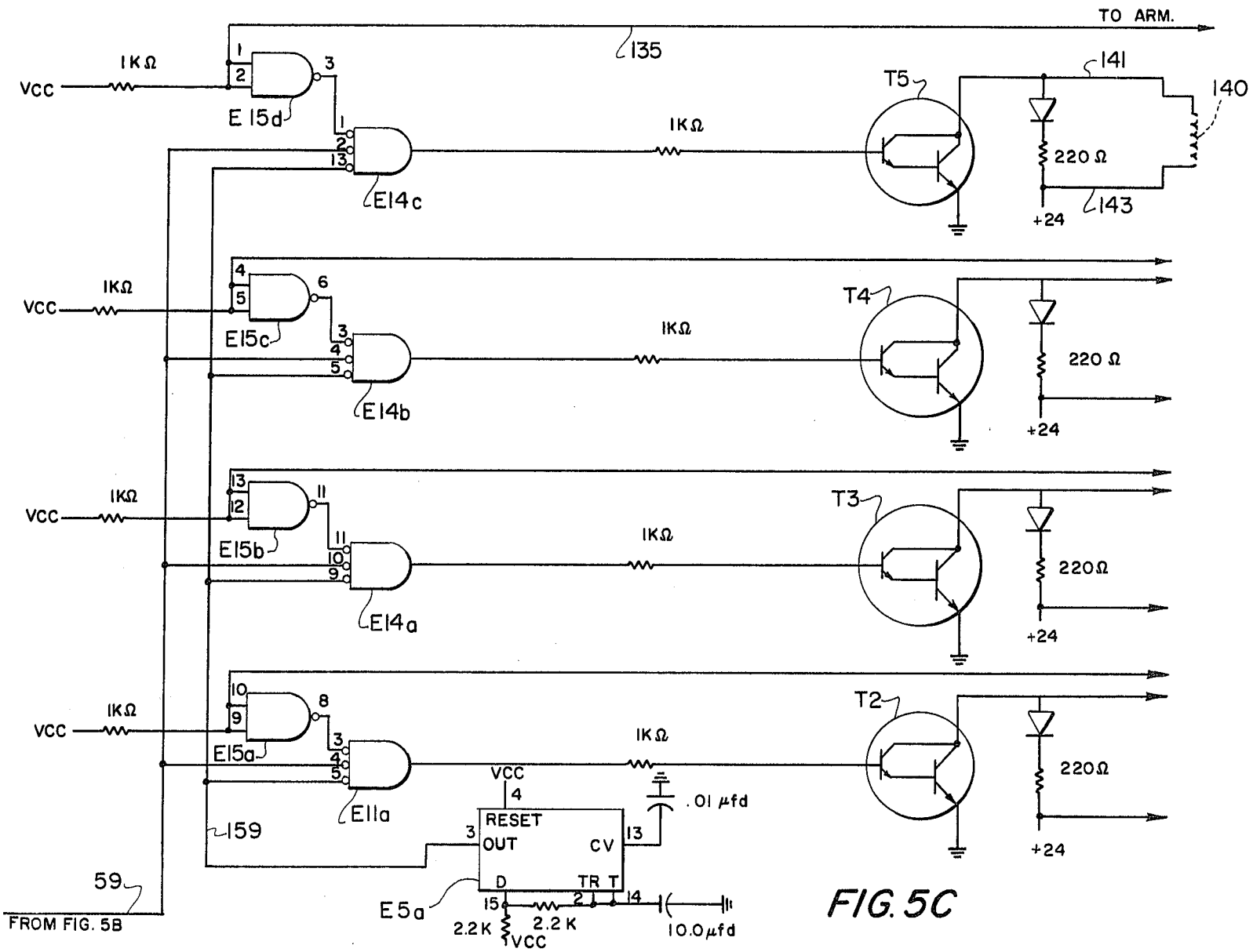
Figure 5D:
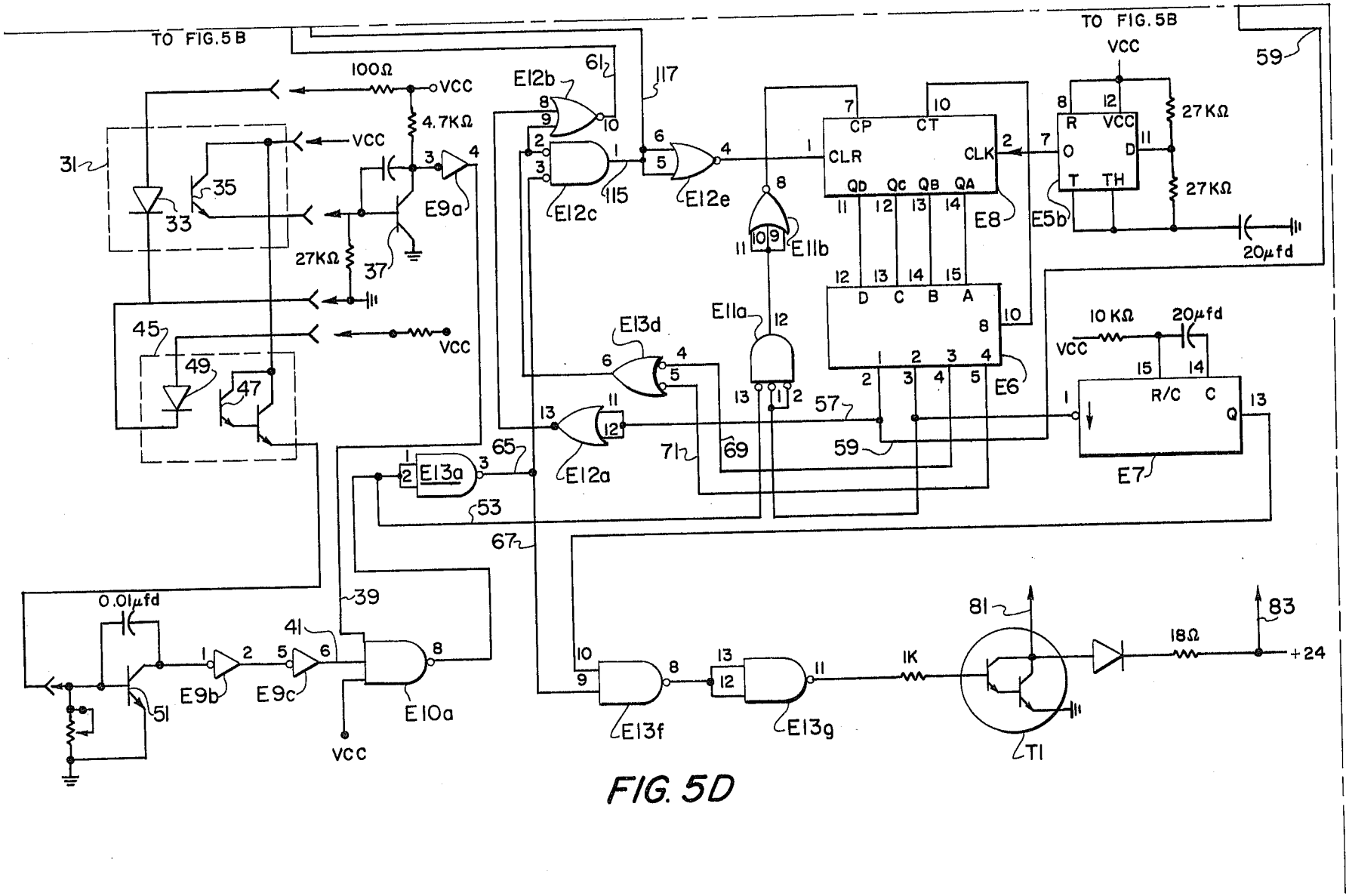

In FIG. 4, the lottery version of the invention is shown in block form with ticket 2 being sensed by TICKET SENSING UNIT 12 to apply a control signal over lead 13 to RANDOM NUMBER GENERATOR 14 which stops the generator with the BCD number stored in SAMPLE AND HOLD LATCH MEMORY 15. This number is displayed at DISPLAY 3' and is also applied to PRINTER 16. LOCATION MODULE 17 supplies information to ENCODER 18 with respect to the site of the unit and ENCODER 18 derives a control number from a portion of the LOCATION MODULE 17 information and from the random number derived from SAMPLE AND HOLD LATCH MEMORY 15 to generate a control number which is also applied to PRINTER 16, along with the LOCATION MODULE number — all for printing on ticket 2.

The sensor circuitry, which initiates operation of the device, including the printer, and serves to identify acceptable cards, is shown at the lower left-hand corner of the composite drawing. Left opto-sensor (chip) 31 (optical electronic module for reflective sensing applications; also known as reflective object sensor) is provided to detect the presence of a ticket which is inserted into the game housing 1 to block the light from light emitting diode 33 to photo-transistor 35 of chip 31. (Note the preferred component types are listed in a table at the end of this description).

The output of this chip is normally low in the presence of light, and goes high when the light is blocked so that the remaining portion of this card detection circuit receives a high indicating the presence of a ticket. This further circuitry includes transistor 37, connected between ground and regulated voltage supply VCC, to provide a conventional transistor amplifier for the low level opto output to gate E9*a*, connected in the Schmitt trigger mode, at input pin 3. The output from gate E9a at pin 4 is high, indicating card inserted, and this signal follows lead 39 to AND gate E10*a* at pin 13. The other input lead 41 for AND gate E10a delivers a signal from the right optosensor (chip) 45, provided it has detected the proper validation mark(s). The presence of the ticket provides reflective validating markings 5*a* and 5*b* for the photo-transistor 47 to pick up, due to light emitting diode 49 of chip 45. The remaining portion of this sensor detection circuit comprises the amplifier circuit utilizing transistor 51.

While the printer (10 or 16) is a conventional off-the-shelf item, it is selected to provide a flat, black, non-reflective surface for the opto when no ticket is inserted. The ticket stock should preferably be of a reflective nature so as to provide a high off-on ratio to the detector.

Amplifier transistor 51 provides a high, when right opto-sensor 45 is reading validating indicia, to pin 1 of Schmitt trigger E9*b*, which high is inverted at output pin 2, and applied to inverter E9*c* at pin 5 to provide a high at pin 6 to AND circuit E10*a*.

The presence of two highs at AND circuit E10*a* provides a low at output pin 8 which low signal follows two paths. Lead 53 extends to gate E11*a* at input pin 13 and through second gate E11b at input pin 10 to appear at output pin 8 as the input to program counter E8. Program counter E8 is normally continuously cycling between four states or modes of operation (shown at 1, 2, 3, 4 on decoder E6). It is driven by oscillator E5*b* running at about 1Hz. The detection signal at input 7 stops the program counter E8 in stage 1 which had been continuously sensing for ticket detection. The BCD output lines from program counter E8 extend to the one-of-ten detector E6 and stage 1 is connected to leads 57 and 59. Lead 57 extends to OR gate E12*a* at input 12 and via pin 13 to OR gate E12*b* at input pin 8. The output of the last-mentioned OR gate from pin 10 extends over lead 61 to disable the display counters E24 through E27.

Lead 59 from decoder E6 extends to the print wheel driver enable, i.e., pin 4 of E11a, pin 10 of E14*a*, pin 4 of E14*b* and pin 2 of E14*c*.

Returning to the output from the sensor circuit, namely AND gate E10*a*, the other lead 65 from inverter E13*a* branches upwardly over lead 67 to AND gate E12*c*. This AND gate has a high on pin 2, also as a result of OR circuit E13*d* because its input pins 4 and 5 extend over leads 69 and 71 to output stages 4 and 5 of one-of-ten decoder E6. Hence, clear at pin 1 of program counter E8 is inhibited via OR E12*e* to start this counter to run.

The other output lead from inverter E13*a* at pin 3 (now high) is 75 which extends to solenoid gate AND circuit E13*f* on pin 9. Pin 10 of AND gate E13*f* receives the output of one-shot E7 over lead 77. This multivibrator component produces a 50 millisecond, 24 volt pulse, which causes the printer solenoid to actuate and print the ticket.

AND circuit E13*f* is another circuit which again verifies that the ticket is still present in the machine by virtue of its input lead at pin 9. The high output from E13*f* at pin 8 passes through inverter E13*g* at pin 11 to Darlington power transistor T1 to develop 24 volts between output leads 81 and 83 of 50 millisecond duration for causing the solenoid (not shown) to print the ticket.

The above-described circuitry remains in the condition just described so long as the ticket is in the housing. Upon removal of the ticket, counter input to program counter E8 goes high enabling the counter to step through stages 3 and 4. This is because gate E11*a* at input lead 13 is looking for an AND signal due to the presence of a ticket over lead 53 and no such signal exists after removal.

Thus, in the control circuitry, the first state of program counter E8 operation is a no-op associated with the absence of a ticket. The next state asserts: load enable and print wheel drivers enable; while the third state asserts: OR gate E11*b* if the ticket is still inserted so that this configuration inhibits counter E8 through its C*p*. Upon removal of the ticket, counter E8 input C*p* goes high enabling the counter. The program then automatically advances through states 3 and 4 and gates E12*a* and E12*b* maintain display load. When counter E8 advances past the fourth stage, gates E12*c* and E12*e* clear the counter and inhibit counter latch. No further operation occurs until another ticket is inserted.

In the ensuing description, the display counters (11 FIG. 3) and display drivers for providing the attractive flashing numbers will be described. The counters which are driven selectively up and down are shown at E24 through E27 in the composite drawing; each being an independent decade counter without any carry connection.

Astable multivibrators E28*a* and E28*b* drive display counters E24 over lead 99 and E26 over lead 101. Astable multivibrators E29*a* and E29*b* drive counters E25 over lead 103 and E27 over lead 105. The configuration is given in the following table:

| DIGIT | COUNTER | DIREC-TION | ASTABLE | FREQUENCY |
|---|---|---|---|---|
| MSD | E27 | UP | E29b | 6.4 Hz. |
| 3 | E26 | DWN | E8b | 9.41 Hz. |
| 2 | E25 | UP | E29a | 11.7 Hz. |
| LSD | E24 | DWN | E29a | 7.06 Hz. |

From the foregoing table it will be seen that counters E27 and E25 are driven up at frequencies of 6.4 Hz. and 11.7 Hz., whereas counters E26 and E24 are driven down at frequencies of 9.41 Hz. and 7.06 Hz. These are the respective frequencies of the astable multivibrators, and the appearance of these "dancing numbers" serves as an attraction for the device.

Prior to the load being asserted, the counters E2-4–E27 advance as dictated by the respective astable oscillators. Their outputs are decoded by seven-segment decoders E19, E18, E17 and E16. In each instance, the counters are connected to the decoders over four lines for the BCD numbers. The decoders, over their seven output leads marked 1–7 for decoder E16, 11–17 for decoder E17, 18–24 for decoder E18 and 27–33 for decoder E19, are brought out for extension to the seven-segment digit display, a conventional device not shown in detail but rather by the block 3 of FIG. 3.

The next section of this description will be devoted to the random number generators E30, E31, E32 and E33 which provide the winning number for ticket printout and display. When the electrical cord of housing 1 is plugged into a 110 volt AC outlet, the generators start their continuous running, powered by a conventional dc supply (not shown) providing VCC. Plug-in also initiates operation of the dancing lights. Oscillators F10 runs at 20 KHz and is connected over lead 105 to drive random counter E30. This units counter is connected to tens counter E31 over carry lead 107. The tens counter is connected over carry lead 109 to hundreds counter E32 in turn connected to thousands counter E33 over carry lead 111.

The display memory for the random number generators are the latches E20, E21, E22 and E23 connected to the respective random number decade counters over the four lead BCD connections.

The random generator counters are running continuously, and in the present embodiment, run from zero to 9999 and repeat, it being appreciated that further stages can be added using the principles herein explained to increase the size of the printed random number.

When the ticket is inserted into the device, the high on lead 65 at the output of inverter E13*a* is applied over lead 67, through inverter AND E12*c* to follow leads 115 and 117 onto common latch enabling lead 119. Thus, when latch low is asserted by the control logic, the random state present at that moment is held at the output of latches E20–E23.

Display of the latch memory number is achieved using the same decoders E16–E19 heretofore described and employed in connection with the dancing number which is now inhibited over common load leads 61 and 121 from OR circuit E12*b*, as previously explained.

Thus, decoders E16–E19 are available to decode the outputs of latches (memories) E20–E23 over the four line BCD common leads to permit display of the printed random number via the heretofore mentioned seven-segment displays.

The next section will describe the printer drive for the printed number. Decoders E1, E2, E3 and E4 provide one-of-ten decoding of the latched random digits from the output BCD lines from latches E23–E20. Looking at one-of-ten counter E1, it will be seen that there is a typical illustration (for the remaining one-of-ten decoders) of the associated portion of the thousands digit printer of a conventionally available device such as a HECON BCD to decimal printer. The zero-through-nine output leads of E1 extend to the ten contacts of stepping switch digit printer 131. Armature 133 is connected to lead 135 which is the power Darlington output to the printer. In this manner the information from the one-of-ten decoder E1 is passed to the print heads, operated by the respective Darlington power transistors T2 through T5. The coil for operating the stepping switch for the thousands digit is shown in dotted outline at 140 across leads 141 and 143 of power transistor T5.

Armature 133 is caused to step by virtue of solenoid 140, sequentially from position to position until it reaches the grounded level, which is the thousands digit to be printed. This inhibits further movement of the armature and the print wheel is in position to print the digit in latch E23. These same connections are, of course, extended for the hundreds, tens and units digits to print the numbers in latches E22–E20.

The print gates are shown as E11*a*, E14*a*–E14*c* and E15*a*–E15*d*. These gates are enabled over leads 59 and 159, the latter extending to oscillator E5A having an output of 20 Hz. which is the frequency for cycling the print modules. Lead 59 carries an enabling signal to enable the print wheel drive when program counter E8 cycles to stage 2 at one-of-ten decoder E6.

Thus, oscillator E5A, through power transistors T5–T1, advances the print heads at the 20 Hz. rate. When the print position corresponds to the decoded location, the print wheel is inhibited and thereafter power transistor T1, enabled at stage 2, so long as the ticket is present, operates the print solenoid (not shown) which is connected between leads 81 and 83 to cause all four print wheels to print.

The following table depicts the preferred type solid state component for each element shown in the drawings:

| | |
|---|---|
| Left Opto-Sensor | 139 |
| Right Opto-Sensor | Monsanto MCA7 |
| Sensing transistors 37 and 51 | 2N3904 |
| E9 | 7414 |
| E10 | 7413 |
| E11 | 7427 |
| E12 | 7402 |
| E13 | 7437 |
| Counter E8 | 7416 |
| One-of-ten decoder E6 | 7442 |
| Oscillators E5A and E5B | 555 |
| Multivibrator E7 | 74123 |
| Power transistors T1–T5 | MJ4035 |
| E14a–c | 7427 |
| E15a–b | 7400 |
| Random generators E30–E33 | 74LS192 |
| Latches E20–E23 | 7475 |
| Astable multivibrators E28a–b & E29a–b | 555 |
| Decoders E1–E4 | 7441 |
| Display counters E24–E27 | 74LS192 |
| Decoders E16–E19 | 7446 |

What is claimed is:

1. An instant totally chance game method utilizing a ticket for receiving a multi-digit random number from a random number generator upon insertion into the game housing comprising the steps of:
sensing the presence of the ticket;
deriving the random number from said random number generator in response to said sensing;
transferring the random number to memory means; and,
decoding the random number in the memory means for printing upon said ticket to determine any win from said multidigit random number.

2. The method of claim 1 comprising the further step of validating the ticket which is being sensed.

3. The method of claim 1 comprising the further step of creating a changing number display as an attraction.

4. The method of claim 3 wherein the step of creating a changing number display comprises:
establishing a plurality of counters each independently continuously running at different speeds with selected counters running up and non-selected counters running down.

5. Instant totally chance game apparatus of a type which utilizes a ticket for receiving a randomly generated printed number comprising in combination:
means for sensing the presence of the ticket when inserted into the apparatus by a player;
random number generator means adapted for continuous operation;
means responsive to the sensing means to stop thee random generator means;
memory means for receiving a number from the stopped random number generator means; and,
means for printing said number upon said ticket to determine any win using said multi-digit number.

6. The apparatus of claim 5 further comprising a program controller for sequencing the operation of said apparatus.

7. The apparatus of claim 6 comprising further means in the sensing means for validating the ticket being sensed.

8. The apparatus of claim 7 further comprising means for generating a changing number; and,
display means for displaying said changing number as an attraction.

9. The apparatus of claim 8 wherein said means for generating changing numbers comprises a plurality of individual counters and astable multivibrator means for driving each counter continuously.

10. The apparatus of claim 9 wherein said random generator means comprises a plurality of individual counters connected together for carry transfer; and,
wherein said printing means comprises a plurality of printing wheels respectively driven in accordance with the digits of said number.

11. The apparatus of claim 10 further comprising decoder means for the number from said memory means and wherein said display comprises seven-segment display means connected to the decoder means to display said number.

12. The apparatus of claim 11 further comprising an oscillator for cycling said program counter.

13. The apparatus of claim 12 further comprising printing wheel driver circuits; and,
an oscillator for enabling said printing wheel driver circuits.

14. The apparatus of claim 13 further comprising a print circuit and a print solenoid;
said printing wheel driver circuit being enabled under control of said program counter and said print circuit energizing said print solenoid to cause all said print wheels to print simultaneously.

15. The method of an instant totally chance game wherein a ticket is utilized to stop a continuously running number generator upon insertion therein by a player and actuate a printer for printing information including at least a random number on which the generator stopped on the ticket comprising the steps of:
initiating operation of the number generator;
inserting the ticket into a housing for the generator to stop the generator on a random number;
applying the random number generated to an encoding matrix along with a location number to generate a control number comprising information derived from the random number and the location number;
printing the random number, the control number and the location number on said ticket; and,
resetting said game for replay upon the withdrawal of said ticket.

16. The method of claim 15 comprising the further steps of:
validating the ticket upon insertion into the housing by sensing predetermined indicia, and
displaying said selected random numer while the ticket is in said housing.

17. Instant game apparatus of a type employing a ticket for actuation comprising in combination:
a housing;
random number generator means, encoding matrix means and printer means within said housing;
sensing means for validating the ticket upon insertion into said housing and developing a sample/hold command;
said random number generator means being responsive to the sample/hold command to develop a random number applied to the printer and the encoding matrix;
means applying a location number to the encoding matrix whereby a control number is generated by the encoding matrix and applied to said printer;
said printer printing the random number, location number and control number on said ticket; and,
means for resetting the apparatus upon withdrawal of the ticket from said housing.

* * * * *